US006963161B1

(12) United States Patent
Misztal

(10) Patent No.: US 6,963,161 B1
(45) Date of Patent: Nov. 8, 2005

(54) LIGHT BULB ASSEMBLY HAVING A LIGHT BULB WITH THE ABILITY TO CHANGE COLOR

(76) Inventor: Goslav Misztal, 360 W. Ocean Blvd. Apt G, Long Beach, CA (US) 90802

( * ) Notice: Subject to any disclaimer, the term of this patent is extended or adjusted under 35 U.S.C. 154(b) by 163 days.

(21) Appl. No.: 10/425,452

(22) Filed: Apr. 28, 2003

(51) Int. Cl.[7] ..... H01K 9/00; H01K 9/04
(52) U.S. Cl. ..... 313/316
(58) Field of Search ..... 313/483, 484, 313/115, 567, 573, 574, 580–81, 609, 631, 313/637, 243, 245, 256, 271–279, 315, 318, 313/323, 324, 333, 343, 356

(56) References Cited

U.S. PATENT DOCUMENTS 1,688,549 A * 10/1928 Llaurado ..... 313/112
1,818,183 A * 8/1931 Wood ..... 313/273
1,825,078 A * 9/1931 Marette ..... 439/613
1,874,355 A * 8/1932 Round ..... 313/247
2,074,246 A * 3/1937 Adler, Jr. ..... 340/931
2,416,315 A * 2/1947 Hartman ..... 331/98
3,882,353 A * 5/1975 Ackley ..... 315/68
3,885,185 A * 5/1975 Tilley ..... 313/318.03
4,337,414 A * 6/1982 Young ..... 315/56

* cited by examiner

*Primary Examiner*—Joseph Williams
*Assistant Examiner*—Elizabeth Rielley
(74) *Attorney, Agent, or Firm*—Goldstein Law Office, P.C.

(57) ABSTRACT

A light bulb assembly having a light bulb with the ability to change color. The light bulb assembly comprises a light bulb, a socket for containment of the light bulb, and a light switch assembly for selectively providing current to the socket and attached light bulb. The light bulb has three filaments which separately emit white light upon selective illumination. Two of the filaments, however, are separately encased by a sleeve of translucent, differently colored material. Accordingly, the white light emitted by each of the latter two filaments is filtered by the colored sleeves, and these filaments thereby produce colored light. The switch assembly has three switches, each of which selectively illuminates one of the filaments. The light bulb assembly is thereby able to selectively provide white light as well as differently colored light on different occasions.

11 Claims, 5 Drawing Sheets

LIGHT BULB ASSEMBLY HAVING A LIGHT BULB WITH THE ABILITY TO CHANGE COLOR

BACKGROUND OF THE INVENTION

The invention generally relates to a light bulb assembly, and in particular relates to a light bulb assembly having a light bulb with the ability to change color.

A preponderance of light bulbs are used to produce white light, which is the type of light most often used for conducting everyday activities. Certain activities, however, require colored lights. As one example, for decorative purposes, a user may want to utilize a colored light bulb for providing a particular ambience to a room, on a specific occasion. In order to illuminate the colored light bulb, the user must generally thread the colored light bulb within a socket. This often requires removing a white light bulb from a socket and replacing it with the colored light bulb. Alternately, this may require threading the colored light bulb into a separate, additional light bulb socket. Consequently, there is a need for a light bulb assembly having a light bulb with the ability to change color, so that a user does not have to interchange a white light bulb with a colored light bulb, or to use a separate socket for illumination of the colored light bulb.

SUMMARY OF THE INVENTION

It is an object of the invention to produce a light bulb assembly having a light bulb with the ability to produce colored light as well as white light. Accordingly, the light bulb assembly has a light bulb having three separate filaments. Although each filament emits white light, two of the filaments are separately encased by different colored sleeves, and thereby produce colored light.

It is another object of the invention to produce a light bulb assembly with the ability to emit white light or differently colored light on different occasions, depending on the user's preference. Accordingly, the light bulb assembly has a switch assembly having a separate switch for activating each of the filaments of the light bulb, and thereby allows the user to choose whether to employ white lighting or colored lighting on different occasions.

It is an additional object of the invention to produce a light bulb assembly which is not unduly expensive. Accordingly, the components of the light bulb assembly are manufactured from readily available materials, and the cost of the light bulb assembly is not prohibitive.

The invention is a light bulb assembly having a light bulb with the ability to change color. The light bulb assembly comprises a light bulb, a socket for containment of the light bulb, and a light switch assembly for selectively providing current to the socket and attached light bulb. The light bulb has three filaments which separately emit white light upon selective illumination. Two of the filaments, however, are separately encased by a sleeve of translucent, differently colored material. Accordingly, the white light emitted by each of the latter two filaments is filtered by the colored sleeves, and these filaments thereby produce colored light. The switch assembly has three switches, each of which selectively illuminates one of the filaments. The light bulb assembly is thereby able to selectively provide white light as well as differently colored light on different occasions.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 3:
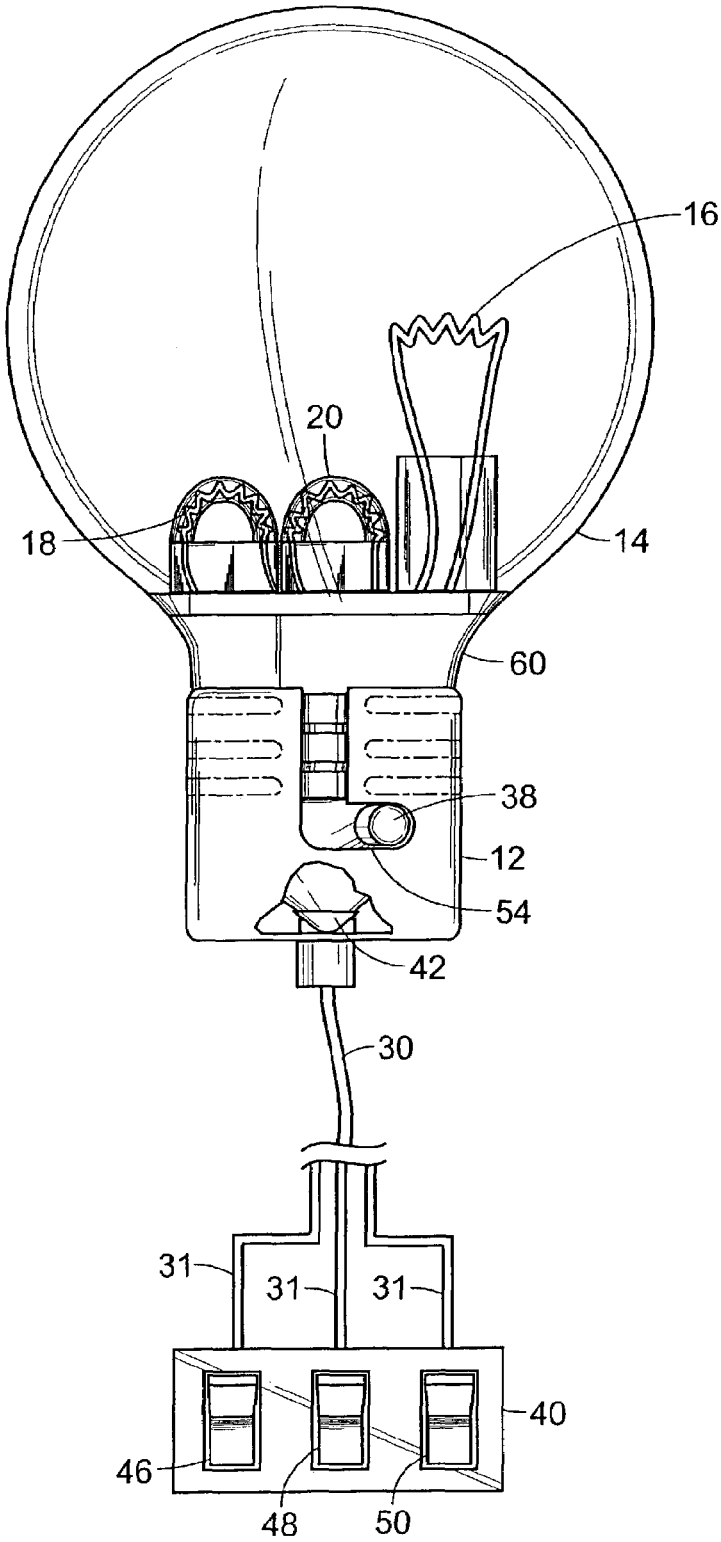
FIG. 3 is a front elevational view of the first embodiment of the light bulb assembly, wherein the socket is in electrical communication with a light switch assembly.

FIG. 3 illustrates a first embodiment of a light bulb assembly 10, comprising a light bulb 14, a socket 12, and a light switch assembly 40. The light bulb 14 has a primary filament 16, a secondary filament 18, and a tertiary filament 20, each of which separately emit light upon selective illumination by a power source. The light switch assembly 40 correspondingly has three switches 46,48, and 50, each of which selectively supplies current to one of the filaments 16,18, and 20. The light switch assembly 40 is described in further detail below.

Figure 1:
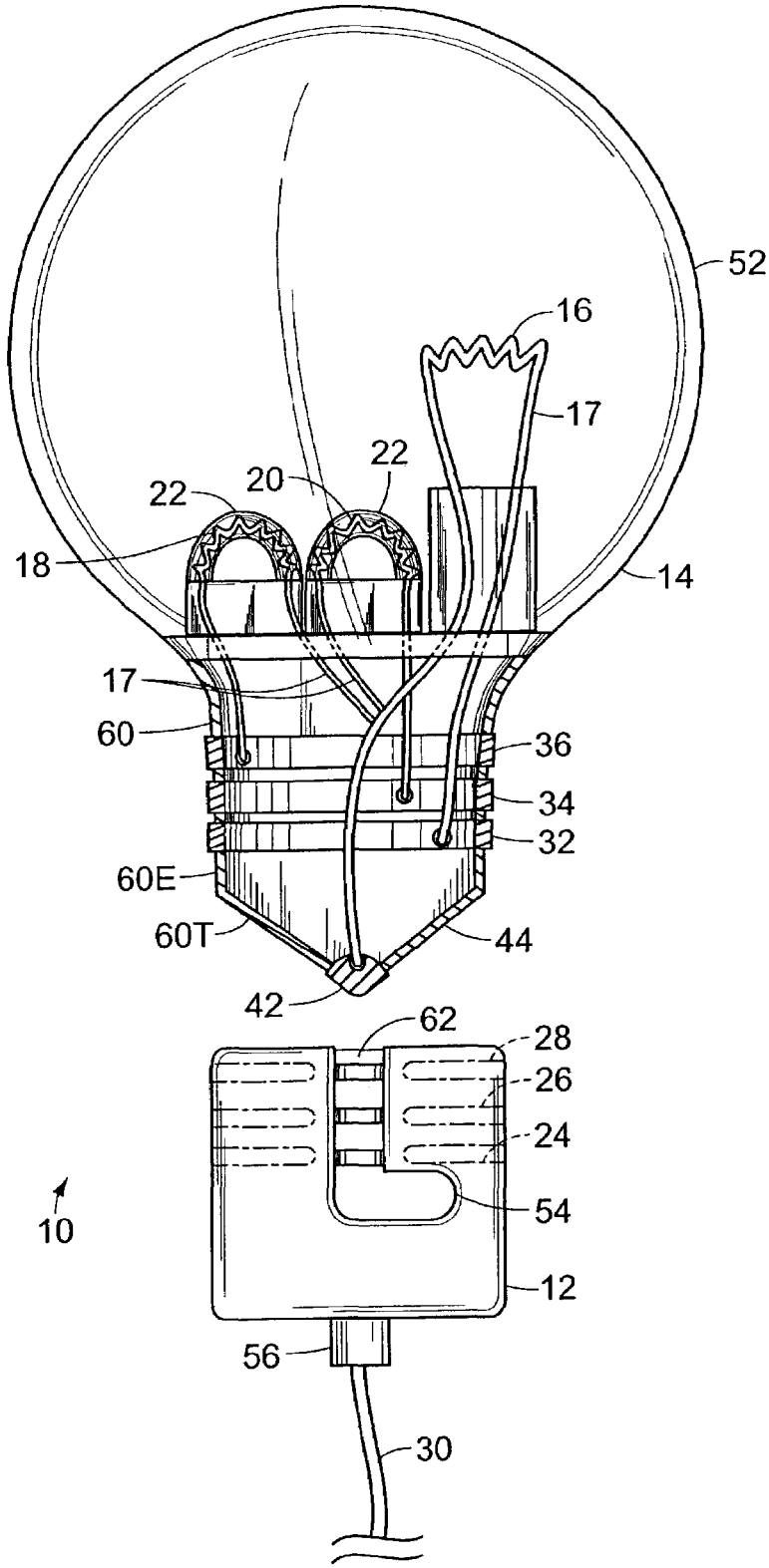
FIG. 1 is a front elevational view of a first embodiment of a light bulb assembly with parts broken away to show electrical circuits contained therein.

FIG. 1 illustrates the light bulb 14 and the socket 12, prior to selective insertion of the light bulb 14 into the socket 12. Portions of the light bulb 14 have been broken away to illustrate internal details thereof. The light bulb 14 has a substantially spherical clear glass envelope 52 and a base 60 having a ground contact 42 for grounding each of the filaments 16,18, and 20. The base 60 is selectively inserted into the light bulb socket 12. The glass envelope 52 encloses the primary filament 16, the secondary filament 18, and the tertiary filament 20. The filaments 16,18, and 20 are coiled and are each supported by two support wires 17. One of the support wires 17 extending from each filament 16,18, and 20 is connected to the ground contact 42. Accordingly, in order to illuminate each filament, power must also be supplied to its other support wire 17 to complete a circuit through that filament. The glass envelope 52 contains an inert gas and is sealed from the surrounding atmosphere. Accordingly, the glass envelope 52 prevents the filaments 16,18, and 20 from coming into contact with oxygen and other reactive gases which would cause the filaments 16,18, and 20 to oxidize or burn upon illumination. The filaments 16,18, and 20 each emit white light upon illumination. However, the secondary filament 18 and the tertiary filament 20 are each separately encased by a translucent colored sleeve 22 having a particular color. Consequently, the white light which is emitted by the secondary filament 18 and the tertiary filament 20 is subsequently filtered by the colored sleeves 22 which surround each of the filaments 18 and 20. Accordingly, after passing through the colored sleeves 22, the filtered light produced by the secondary filament 18 and the tertiary filament 20 is of the same color as the particularly colored translucent sleeve 22 surrounding each of said filaments 18 and 20. The particular color of the colored sleeve 22 which encases the secondary filament 18 is different from the particular color of the colored sleeve 22 which encases the tertiary filament 20. Accordingly, the secondary filament 18 and the tertiary filament 20 each selectively produce light of a different color. A variety of light bulbs 14 having variously colored sleeves 22 are provided with the light bulb assembly 10, in order to provide a user with a choice of different light bulbs 14, each capable of producing differently colored light as well as white light. The primary filament 16, the secondary filament 18, and the tertiary filament 20 are each separately illuminable by the switches 46,48, and 50, respectively. Accordingly, the light bulb assembly 10 is capable of emitting white light as well as differently colored light, depending on which of the switches 46,48, and 50 of the light switch assembly 40 have been activated.

The primary filament 16 may be high wattage. The secondary filament 18 and the tertiary filament 20 are preferably lower wattage, up to a maximum of 15 watts, in order to keep the filaments 18 and 20 from overheating and damaging the colored sleeves 22.

The base 60 of the light bulb 14 has an outer surface 60E having an insulated portion 44 and three electrically conductive ring contacts 32,34, and 36. The base 60 terminates in a tip 60T having the ground contact 42 which completes a circuit through one of the filaments when power is also applied to one of the ring contacts 32,34, and 36. The first ring contact 32 is in electrical communication with the primary filament 16. The second ring contact 34 is in electrical communication with the secondary filament 18. The third ring contact 36 is in electrical communication with the tertiary filament 20.

The light bulb assembly 10 additionally comprises the unique socket 12. The socket 12 selectively conducts an electric current from the power source to the filaments 16,18, and 20. The socket 12 has a substantially cylindrical socket sleeve 62 for insertion therein of the light bulb 14. The sleeve 62 is encircled by three electrical contacts, namely, a first socket contact 24, a second socket contact 26, and a third socket contact 28. The socket 12 further has a base socket contact 56 which contacts the ground contact 42 when the bulb 14 is selectively inserted into the socket 12. The base socket contact 56 has a main power cord 30 extending therefrom. The main power cord 30 supplies the electric current from the power source which selectively illuminates one or more of the filaments 16,18, and 20 of the light bulb 14.

After inserting the base 60 of the light bulb 14 into the sleeve 62 of the socket 12, the first ring contact 32 of the bulb 14 is in electrical communication with the first socket contact 24, the second ring contact 34 of the bulb 14 is in electrical communication with the second socket contact 26, and the third ring contact 36 of the bulb 14 is in electrical communication with the third socket contact 28. Furthermore, after inserting the base 60 into the socket 12, the base socket contact 56 is in electrical communication with the ground contact 42 of the bulb 14.

FIG. 3 illustrates a view of the first embodiment of the light bulb assembly 10, wherein the socket 12 is in electrical communication with the light switch assembly 40. In this first embodiment, the light switch assembly 40 is positioned at a location external to that of the socket 12. The light switch assembly 40 has the white light switch 46, the first colored light switch 48, and the second colored light switch 50. The white light switch 46 selectively supplies electrical current to the first socket contact 24, and thereby causes the primary filament 16 to emit white light. The first colored light switch 48 selectively supplies electrical current to the second socket contact 26, and thereby illuminates the secondary filament 18. The second colored light switch 50 selectively supplies electrical current to the third socket contact 28, and thereby illuminates the tertiary filament 20. Each switch 46,48, and 50 has a wire 31 extending therefrom for supplying current to one of the filaments 16,18, and 20 of the bulb 14.

In an alternate embodiment of the light bulb assembly 10, a light switch assembly 40 is directly attached to the socket 12 and is an integral part of the socket 12. In such an embodiment, the user chooses which of the filaments will be illuminated by positioning switches located on the outer surface of the socket 12. The switches selectively direct current entering the socket 12 through the main power cord 30 to the individual filaments.

In yet another embodiment having three filaments, the light switch assembly 40 has a "dimmer" switch for selectively providing a range of magnitudes of electric current to the primary filament, a two-position light switch for selectively illuminating the secondary filament, and a two-position light switch for selectively illuminating the tertiary filament. The dimmer switch allows the user to incrementally adjust the amount of white light provided by the primary filament. The two-position switches, of course, do not allow the user to incrementally adjust the amount of colored light which is emitted by the secondary and tertiary filaments.

Figure 2:
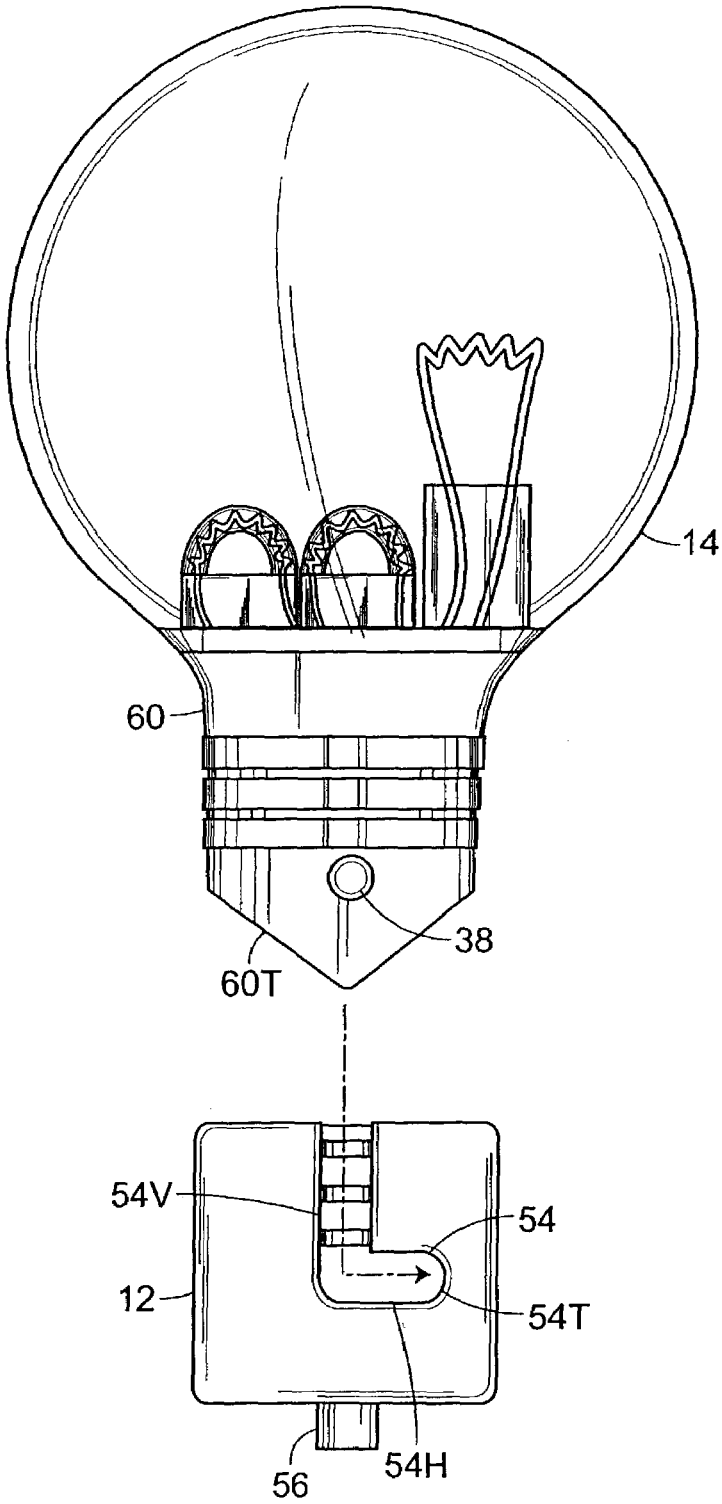
FIG. 2 is a front elevational view of the first embodiment of the light bulb assembly, wherein a light bulb is positioned for selective insertion into a socket.

FIG. 2 illustrates a view of the first embodiment of the light bulb assembly 10, wherein the light bulb 14 is positioned for selective insertion into the socket 12. The tip 60T of the base 60 has a substantially circular jut lock 38 extending substantially horizontally therefrom, for maintaining the light bulb 14 within the socket 12. The socket 12 has a jut lock slot 54 having a vertical track 54V, a horizontal track 54H, and a terminal portion 54T. After extending the jut lock 38 downward within the vertical track 54V of the jut lock slot 54, the light bulb 14 is rotated in the direction of the arrow shown in FIG. 2, thereby causing the jut lock 38 to rotate within the horizontal track 54H until it abuts the terminal portion 54T of the jut lock slot 54. In this position, the ring contacts 32,34, and 36 of the bulb 14 are in electrical contact with the socket contacts 24,26, and 28, respectively. In an alternate embodiment of the light bulb assembly 10, the light bulb 14 has a second jut lock 38 extending from an opposing side of the tip 60T, and the socket 12 has a corresponding second opposing jut lock slot 54 for bracketing the second jut lock 38 therein.

Figure 4:
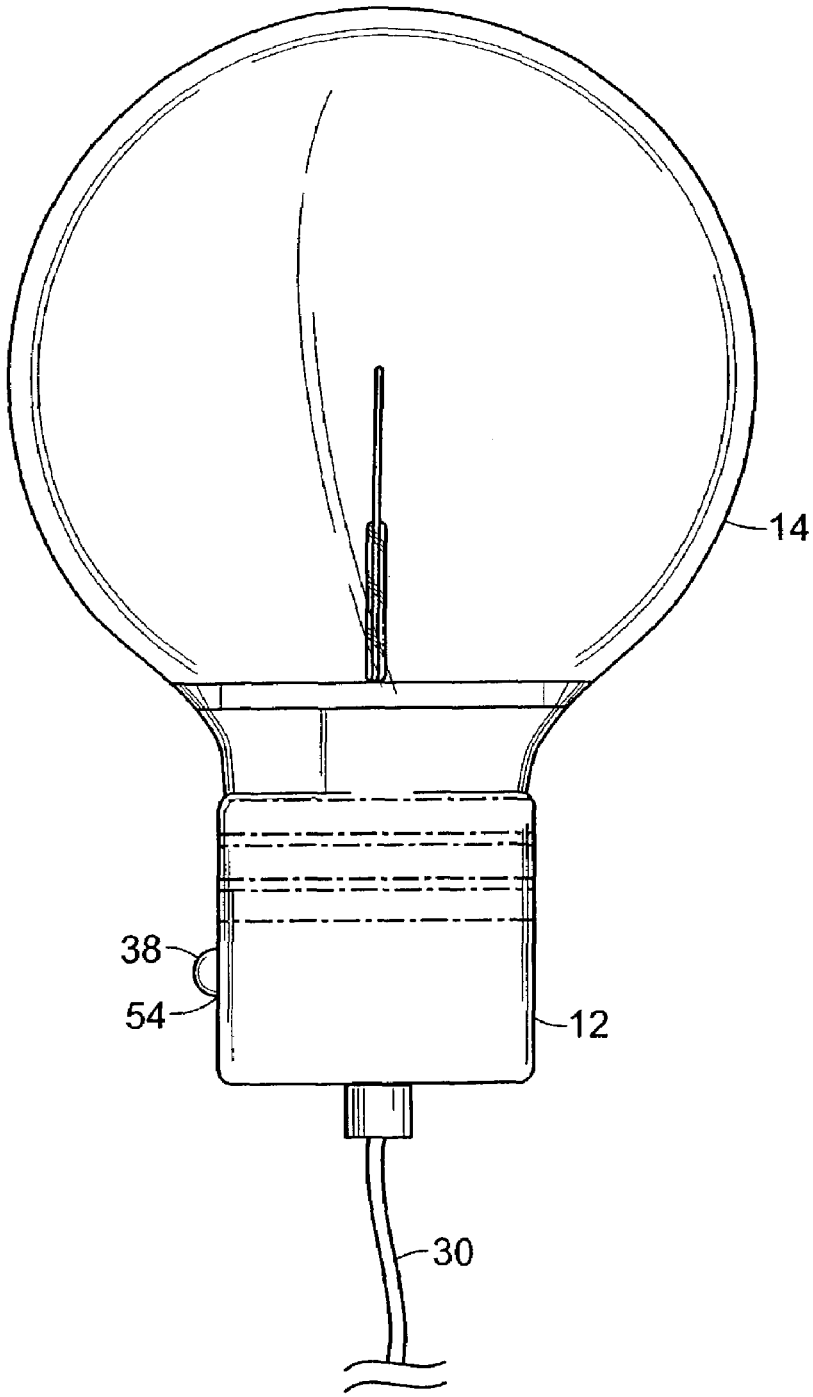
FIG. 4 is a side view of the light bulb assembly.

FIG. 4 illustrates a side view of the light bulb assembly 10, wherein the jut lock 38 extends horizontally outward from the jut lock slot 54.

Figure 5:
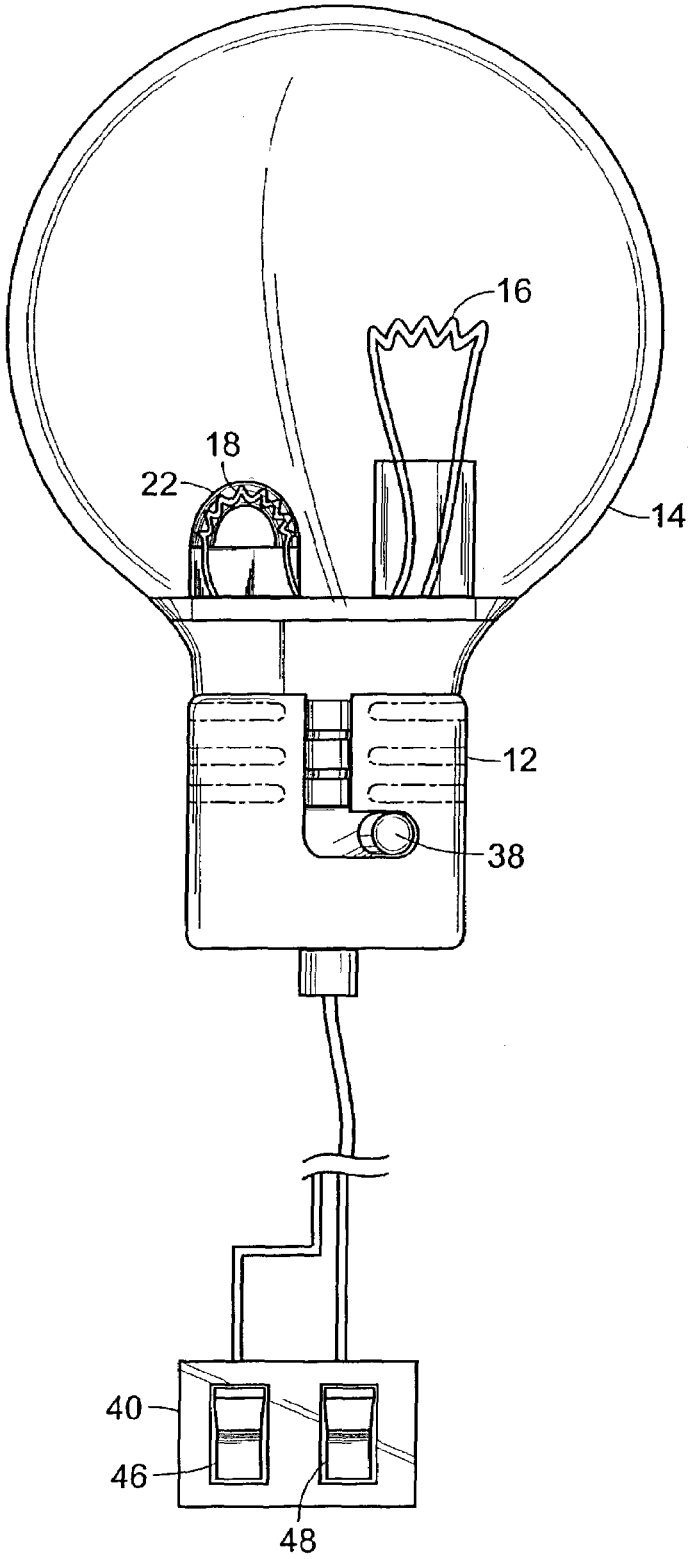
FIG. 5 is a front elevational view of a second embodiment of the light bulb assembly, wherein the socket is in electrical communication with a light switch assembly.

FIG. 5 illustrates an alternate embodiment of the light bulb assembly 10 having only a primary filament 16 and a secondary filament 18. In such an embodiment, the light switch assembly 40 has only two light switches, namely a white light switch 46 and a colored light switch 48. The primary filament 16 and the secondary filament 18 each emit white light upon selective receipt of a current. However, as in the first embodiment, the secondary filament 18 is encased by a colored glass sleeve 22 which filters out certain wavelengths of light. Accordingly, upon illumination, the secondary filament 18 produces colored light of a wavelength determined by the particular color of the colored glass sleeve 22.

In use, a user attaches the light bulb 14 to the socket 12 by first extending the jut lock 38 vertically downward within the vertical track 54V of the jut lock slot 54, and then by rotating the bulb 14 and its associated jut lock 38 within the horizontal track 54V of the jut lock slot 54 until the jut lock 38 abuts the terminal portion 54T of the jut lock slot 54. The user connects the light bulb assembly 10 to a source of electrical power. The user then selectively activates one or more of the switches 46,48, and 50, depending upon whether the user desires the light bulb assembly 10 to emit white light or light of a different color.

In conclusion, herein is presented a light bulb assembly having the ability to change color. The invention is illustrated by example in the drawing figures, and throughout the written description. It should be understood that numerous variations are possible, while adhering to the inventive concept. Such variations are contemplated as being a part of the present invention.

What is claimed is:

1. A light bulb assembly having the ability to emit white light and also colored light, comprising a light bulb having a primary filament and a secondary filament, each capable of separately emitting light upon selective illumination by a power source, said light bulb having a substantially spherical clear glass envelope and a cap, wherein the glass envelope encloses the primary filament and the secondary filament, wherein the glass envelope is sealed from the atmosphere and contains an inert gas for preventing the filaments from burning upon illumination, wherein each of said filaments emits white light upon illumination, wherein the secondary filament is encased by a translucent colored sleeve having a particular color, said colored sleeve for filtering the white light which is emitted by the secondary filament, wherein after being filtered by the colored sleeve, the light which is produced by the secondary filament is of the same color as the particularly colored sleeve surrounding the secondary filament, wherein the cap of the light bulb has an outer surface having a first and a second electrically conductive ring contact, wherein the first ring contact is in electrical communication with the primary filament, and the second ring contact is in electrical communication with the secondary filament.

2. The light bulb assembly as recited in claim 1, further comprising a socket for conducting an electric current to the light bulb, said socket capable of selectively holding said light bulb when the cap of the light bulb is selectively inserted into the socket, wherein the socket has two electrical contacts, namely, a first socket contact and a second socket contact, for conducting current to the first ring contact and the second ring contact of the light bulb, respectively, whereby the socket selectively conducts a separate electric current to each of the filaments, thereby allowing the filaments to be selectively and separately illuminated.

3. The light bulb assembly as recited in claim 2, further comprising a light switch assembly having two switches, each of which selectively supplies current to one of the socket contacts, wherein the light switch assembly is thereby capable of separately illuminating the primary filament and the secondary filament of the light bulb when positioned in said socket, after selective activation of the switch associated with that particular filament.

4. The light bulb assembly as recited in claim 3, wherein the light bulb further comprises at least one additional filament encased by a colored sleeve, wherein the particular color of the colored sleeve which covers each of the at least one additional filament is different from the particular color of the colored sleeve which covers the secondary filament, and wherein each of the at least one additional filaments has a colored sleeve having a different color than the colored sleeve of any of the other at least one additional filaments, in order to provide a light bulb capable of producing a great variety of colored lights, wherein the secondary filament and each of the at least one additional filaments thereby each produce different colored light after filtration of the white light emitted by said filaments by said colored sleeves, wherein the outer surface of the cap of the light bulb has an additional ring contact for each of the at least one additional filaments, wherein the socket further has an additional socket contact for selectively supplying an electric current to each of the at least one additional ring contacts of the bulb, which in turn supplies current to the at least one additional filament, and wherein the light switch assembly further has at least one additional switch for selectively and separately supplying an electric current to each of the at least one additional filaments.

5. The light bulb assembly as recited in claim 4, wherein the cap has a substantially circular jut lock extending substantially horizontally therefrom, and wherein the socket has a jut lock slot, said jut lock and jut lock slot for maintaining the light bulb within the socket, said jut lock slot having a vertical track, a horizontal track, and a terminal portion, wherein after extending the jut lock downward within the vertical track, the light bulb is rotated, thereby causing the jut lock to rotate within the horizontal track until it abuts the terminal portion of the jut lock slot, wherein after so positioning the light bulb within the light bulb socket, the ring contacts of the bulb are in electrical contact with the socket contacts.

6. The light bulb assembly as recited in claim 5, wherein the light switch assembly is positioned at a location external to that of the socket.

7. The light bulb assembly as recited in claim 5, wherein the light switch assembly is attached directly to the socket and is an integral part of the socket, and wherein the user chooses which of the filaments will be illuminated by activating the switches located directly on the socket.

8. The light bulb assembly as recited in claim 6, wherein the switch which selectively supplies current to the primary filament is a dimmer switch for allowing a user to incrementally increase the current to the primary filament, and to thereby choose the brightness of the lighting that is provided upon illumination of the primary filament.

9. The light bulb assembly as recited in claim 8, wherein the primary filament is high wattage, and wherein the at least one filament encased by a colored sleeve is lower wattage, in order to prevent said at least one filament encased by a colored sleeve from overheating.

10. The light bulb assembly as recited in claim 9, wherein the wattage of the at least one filament encased by a colored sleeve is less than fifteen watts.

11. The light bulb assembly as recited in claim 10, wherein the light bulb has a second identical jut lock extending from an opposing side of the cap, and the socket has a corresponding second opposing jut lock slot for bracketing the second jut lock.

* * * * *